US007461832B2

(12) United States Patent
Zhang

(10) Patent No.: US 7,461,832 B2
(45) Date of Patent: Dec. 9, 2008

(54) TWIN LIFTING MACHINERY FOR TWO 40 FEET CONTAINER SHORE CRANE

(75) Inventor: Baohua Zhang, Shanghai (CN)

(73) Assignee: Shanghai Zhenhua Port Machinery Co., Ltd., Shanghai (CN)

( * ) Notice: Subject to any disclaimer, the term of this patent is extended or adjusted under 35 U.S.C. 154(b) by 217 days.

(21) Appl. No.: 11/388,752

(22) Filed: Mar. 24, 2006

(65) Prior Publication Data

US 2006/0261205 A1 Nov. 23, 2006

(30) Foreign Application Priority Data

Apr. 6, 2005 (CN) ..... 2005 2 0040673 U

(51) Int. Cl.
*B66D 1/26* (2006.01)

(52) U.S. Cl. ..... 254/278; 254/290; 254/294; 212/274

(58) Field of Classification Search ..... 254/278, 254/290, 292, 293, 294, 295, 316, 375, 339; 212/274

See application file for complete search history.

(56) References Cited

U.S. PATENT DOCUMENTS 3,654,869 A * 4/1972 Lehrer ..... 104/114
3,704,796 A 12/1972 Dedons et al.
3,788,606 A * 1/1974 Solter ..... 254/290
3,807,582 A 4/1974 Anderson
3,812,987 A 5/1974 Watatani
3,837,503 A 9/1974 Komatsu
3,888,536 A 6/1975 Durenec
4,035,010 A 7/1977 Kawashita et al.
4,244,615 A 1/1981 Brown
4,563,030 A 1/1986 Makino et al.
5,039,275 A 8/1991 Ide
5,167,401 A * 12/1992 James et al. ..... 254/292
5,183,305 A 2/1993 Nordstrom et al.
5,280,880 A * 1/1994 Ewing et al. ..... 254/294
5,671,912 A 9/1997 Langford et al.
5,718,550 A 2/1998 Lanigan et al.
5,775,866 A 7/1998 Tax et al.
5,871,249 A 2/1999 Williams (Continued)

FOREIGN PATENT DOCUMENTS

CN 2225462 4/1996

(Continued)

*Primary Examiner*—Emmanuel M Marcelo
(74) *Attorney, Agent, or Firm*—Dorsey & Whitney LLP

(57) ABSTRACT

A twin lifting machinery for two 40 feet container shore crane is disclosed, comprising motors, high speed shaft brakes, two reductors, a plurality of multiple-project rope reels, and a plurality of reel brakes; wherein at least two motors and two reductors are provided; the input shafts of said two reductors connect to one of the output shafts of the motors respectively, and the output shafts of each reductor connect to the reels, the reel brakes are provided on each reel respectively. The synchronous operation or individual operation of two sets of lifting machineries under electrical control can be carried out, achieving the lifting and lowering operation of two hanger tools of sea side and land side The twin lifting machinery thus can carry out both the synchronous operation of two hanger tools and the individual operation of a single hanger tool, increasing the loading and unloading efficiency of the container crane by more than 60%.

7 Claims, 4 Drawing Sheets

U.S. PATENT DOCUMENTS

| | | | | |
|---|---|---|---|---|
| 5,923,270 | A | 7/1999 | Sampo et al. | |
| 5,951,226 | A | 9/1999 | Fantuzzi | |
| 6,145,680 | A | 11/2000 | Jussila et al. | |
| 6,312,213 | B1 | 11/2001 | Stinis | |
| 6,354,782 | B1 | 3/2002 | Barry | |
| 6,602,036 | B2 | 8/2003 | Takehara et al. | |
| 6,698,990 | B1 | 3/2004 | Dobner et al. | |
| 6,715,977 | B2 | 4/2004 | Dobner et al. | |
| 6,920,963 | B2 | 7/2005 | Faller | |
| 6,991,064 | B2 * | 1/2006 | Ehrenleitner | 182/141 |
| 7,032,763 | B1 | 4/2006 | Zakula, Sr. et al. | |
| 7,270,312 | B1 * | 9/2007 | Phipps et al. | 254/297 |
| 7,284,744 | B1 * | 10/2007 | Lerchenmueller et al. | 254/278 |
| 2003/0168871 | A1 | 9/2003 | Geis | |
| 2003/0189348 | A1 | 10/2003 | Lindstrom | |
| 2004/0032140 | A1 | 2/2004 | Solstad | |
| 2006/0043748 | A1 | 3/2006 | Stinis et al. | |

FOREIGN PATENT DOCUMENTS

| | | | |
|---|---|---|---|
| CN | 1155664 | | 7/1997 |
| CN | 2373421 | | 4/2000 |
| CN | 1415529 | | 5/2003 |
| CN | 1448331 | | 10/2003 |
| CN | 2599327 | | 1/2004 |
| CN | 2628508 | | 7/2004 |
| CN | 1579916 | | 2/2005 |
| DE | 1274299 | B | 8/1968 |
| DE | 39 38 058 | A1 | 5/1990 |
| EP | 1 650 156 | A | 4/2006 |
| FR | 828297 | A | 5/1938 |
| GB | 876647 | | 9/1961 |
| JP | 55-035722 | A | 3/1980 |
| JP | 8 175784 | A | 7/1996 |
| JP | 9-267987 | | 10/1997 |
| JP | 10-324493 | | 12/1998 |
| JP | 2001/240372 | A | 9/2001 |
| JP | 200206848 | A1 | 3/2002 |
| WO | WO 98/34127 | | 8/1998 |
| WO | WO 01/58797 | A1 | 8/2001 |
| WO | WO 01/98195 | A1 | 12/2001 |
| WO | WO 2005/009885 | A1 | 2/2005 |

* cited by examiner

TWIN LIFTING MACHINERY FOR TWO 40 FEET CONTAINER SHORE CRANE

CROSS-REFERENCE TO RELATED APPLICATION

This application claims priority to Chinese patent application 200520040673.6, filed 06 Apr. 2005, the subject matter of which are hereby incorporated by reference in its entirety.

FIELD OF INVENTION

The invention generally relates to cranes, more particularly, relates to a twin lifting machinery for two 40 feet container shore crane.

BACKGROUND OF INVENTION

The increasing requirements of container transportation in the world and the continuous increment of the handling capacity of the container port put forward new and increased demands on the technical equipment for loading and unloading containers, and an urgent need for the design and development of high efficient bank-run container load and unload systems to meet the demand of the lifter productivity needed by the larger ships.

The main lifting machinery of the crane of the prior art carries out the lifting and lowering operation of one hanger tool only, hence only one 40 feet container or two 20 feet containers can be lifted at a time so that limits the production efficiency and does not meet the market requirement.

SUMMARY OF INVENTION

It is an object of the invention to provide a twin lifting machinery for two 40 feet container shore crane.

According to the present invention, a twin lifting machinery for two 40 feet container shore crane is provided, said lifting machinery comprises: motors, high speed brakes, reductors, multiple-project rope reels, and reel brakes connecting to each multiple-project rope reel respectively; wherein two or four motors are provided according to the power requirement; two reductors having high speed input shafts and low speed output shafts are provided; said high speed brakes are provided on one of the input shafts of the reductors respectively; said each one of the multiple-project rope reels is provided on one of the low speed output shafts of the reductors respectively; said reel brakes are provided on corresponding multiple-project rope reels respectively.

According to an embodiment of the present invention, said two reductors provided on the output ends of the motors have a land side output and a sea side output; said land side output connects to the land side mltiple-project rope reel which has four project ropes connecting to a hanger tool; said sea side output connects to the sea side multiple-project rope reel which has four project ropes connecting to another hanger tool.

According to an embodiment of the present invention, two motors are provided as motors; the output end of the motor connects to the input shaft of the reductor, and a high speed brake is provided on the input shaft of the reductor; the output end of the motor connects to the input shaft of the reductor, and a high speed brake is provided on the input shaft of the reductor.

According to an embodiment of the present invention, four motors are provided as motors; each output ends of the two motors connects to one of the input shafts of the reductors respectively, and a high speed brake is provided on the input shaft of the reductor; each output ends of the two motors connects to one of the input shafts of the conductors respectively, and a high speed brake is provided on the input shaft of the reductor.

According to an embodiment of the present invention, reel brakes are provided on said four-project rope reel of the land side; and reel brakes are provided on said four-project rope reel of the sea side.

According to an embodiment of the present invention, reel brakes are provided on each one of the two two-project rope reels of the land side respectively; and reel brakes are provided on each one of the two two-project rope reels of the sea side respectively.

Compared with the prior art, the twin lifting machinery for the two 40 feet container shore crane of the present invention has the following advantages and active effects:

Since two reductors and at least two motors have been used in the present invention, both the synchronous operation and the individual operation of two sets of the lifting machineries in the twin lifting machinery under the electric control can be carried out. The twin lifting machinery can carry out lifting and lowering of two hanger tools of the sea side and the land side, either the synchronous operation of two hanger tools or the individual operation of a single hanger tool is possible, so that the loading and unloading efficiency of the container crane may be increased by more than 60%.

BRIEF DESCRIPTION OF DRAWINGS

The object, concrete structure, features and advantages of the invention may be further understood from the following description of the embodiments of the twin lifting machinery for two 40 feet container shore crane according to the invention referring to the appended drawings in which.

DETAILED DESCRIPTION OF PREFERRED EMBODIMENTS

Figure 1:
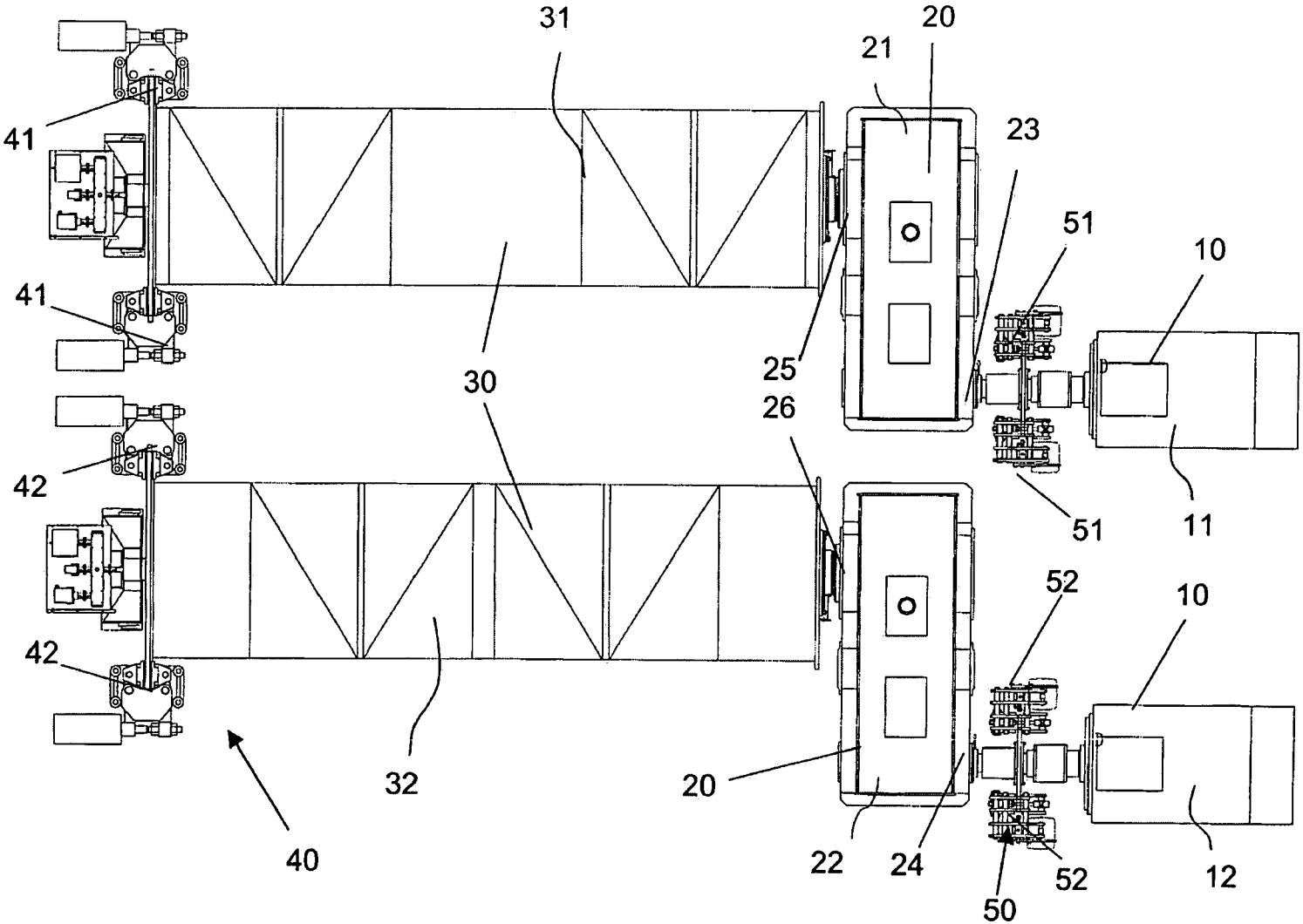
FIG. 1 is the schematic structure view of the first embodiment of the twin lifting machinery with two motors driving two four-project rope reels for two 40 feet container shore crane according to the invention.

Referring to FIG. 1, 2, 3 and 4, the twin lifting machinery for two 40 feet container shore crane according to the present invention (taking two 40 feet containers for example) includes: motors 10, reductors 20 connecting to the motors 10, a plurality of high speed shaft brakes 50 provided on the input ends of the reductors 20, a plurality of project rope reels 30 provided on the output ends of the reductors, and a plurality of reel brakes connecting to each project rope reel respectively.

Two or four motors 10 may be provided according to the motor power, two reductors are provided so that four two-project rope reels 30 may be driven by the two motors 10 through the two reductor 20, four two-project rope reels 30 may be driven by the four motors through the two reductors 20, or two four-project rope reels 30 be driven by the two moters through the two reductors 20, or two four-project rope reels 30 may be driven by the four motors through the two reductor 20.

The First Embodiment

Refer to FIG. 1.

According to the embodiment, the twin lifting machinerys with two motors driving two four-project rope reels for two 40 feet container shore crane includes: motors 10, high speed brakes 50, two reductors 20, two four-project rope reels 30, and reel brakes 40 connecting to the four-project rope reels 30 respectively;

Two motors are provided as motors 10;

The input ends of the two reductors 20 connect to one of the output ends of the motors 10 respectively.

The input ends of the two reductors 20 are provided on one of the high speed brakes 50 respectively;

The four-project rope reels 30 are provided on one of the output ends of the two reductors 20 respectively;

The reel brakes 40 are provided on each four-project rope reel 30 respectively;

The (land side) reductor 21 has an output end 25, the output end 25 connects to a four-project rope reel 31, the four-project rope reel 31 has four project ropes connecting to a hanger tool;

The (sea side) reductor 22 has an output end 26, the output end 26 connects to a four-project rope reel 32, the four-project rope reel 32 has four project ropes connecting to another tool.

The reel brakes 41 are provided on a four-project rope reel 31 of the land side, the reel brakes 42 are provided on a four-project rope reel 32 of the sea side.

The Second Embodiment

Figure 2:
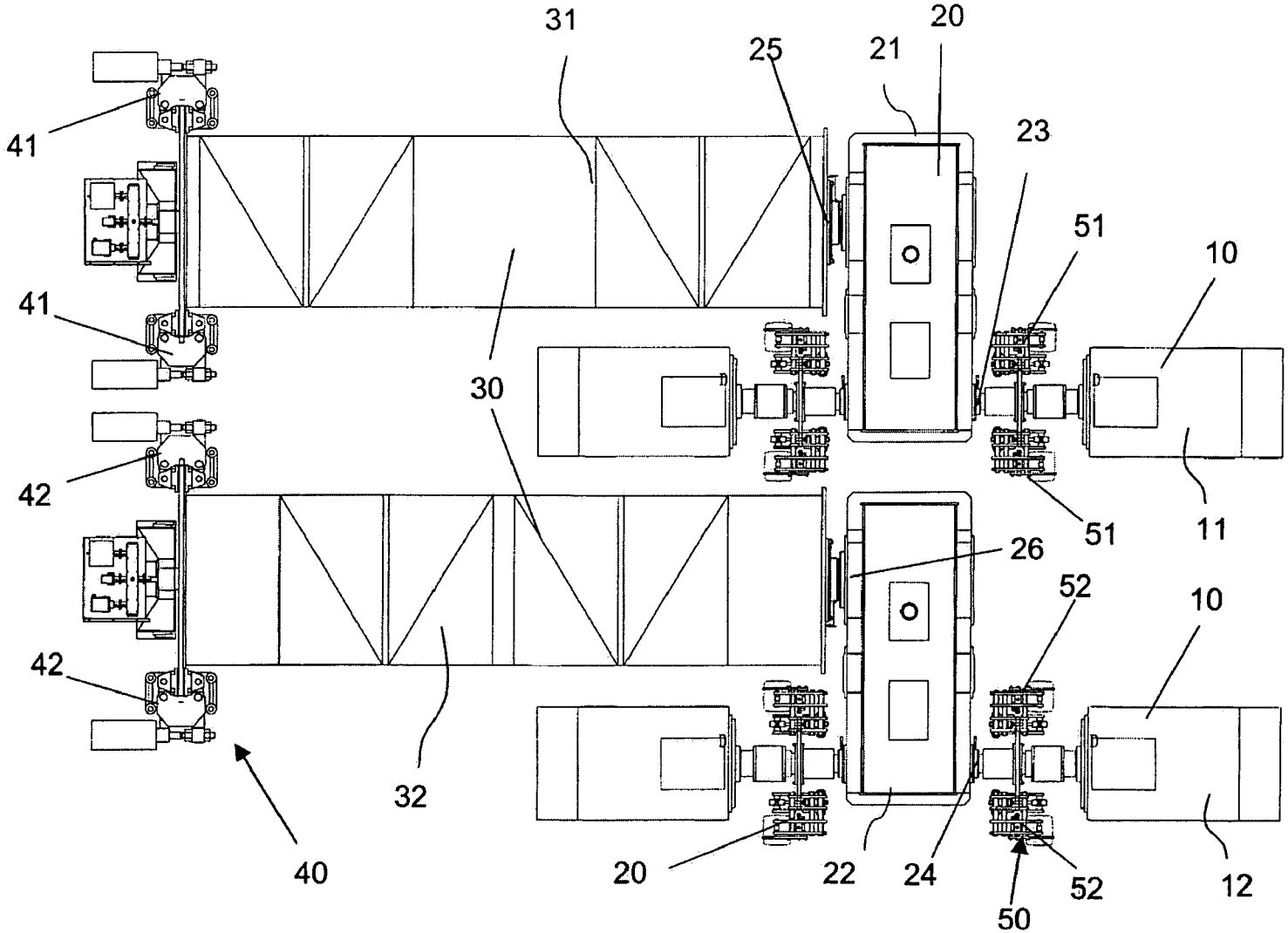
FIG. 2 is the schematic structure view of the second embodiment of the twin lifting machinery with two motors driving two four-project rope reels for two 40 feet container shore crane according to the invention.

Refer to FIG. 2.

According to the embodiment, the twin lifting machinery for two 40 feet container shore crane has four motors driving two four-project rope reels, the twin lifting machinery includes: motors 10, high speed brakes 50, two reductors 20, two four-project rope reels 30, and reel brakes 40 connecting to the four-project rope reels 30 respectively;

Four motors are provided as the motor 10;

Each one of the input ends of said two reductors 20 connect to one of the output ends of the motors 10 respectively.

Each one of the input ends of said two reductors 20 are provided on one of the high speed brakes 50 respectively;

The four-project rope reels 30 are provided on one of the output ends of said two reductors 20 respectively;

The reel brakes 40 are provided on said each four-project rope reel 30 respectively;

The (land side) reductor 21 has an output end 25, the output end 25 connects to a four-project rope reel 31, and the four-project rope reel 31 has four project ropes connecting to a hanger tool;

The (sea side) reductor 22 has an output end 26, the output end 26 connects to a four-project rope reel 32, and the four-project rope reel 32 has four project ropes connecting to another tool.

The reel brakes 41 are provided on a four-project rope reel 31 of the land side, and the reel brakes 42 are provided on a four-project rope reel 32 of the sea side.

The Third Embodiment

Figure 3:
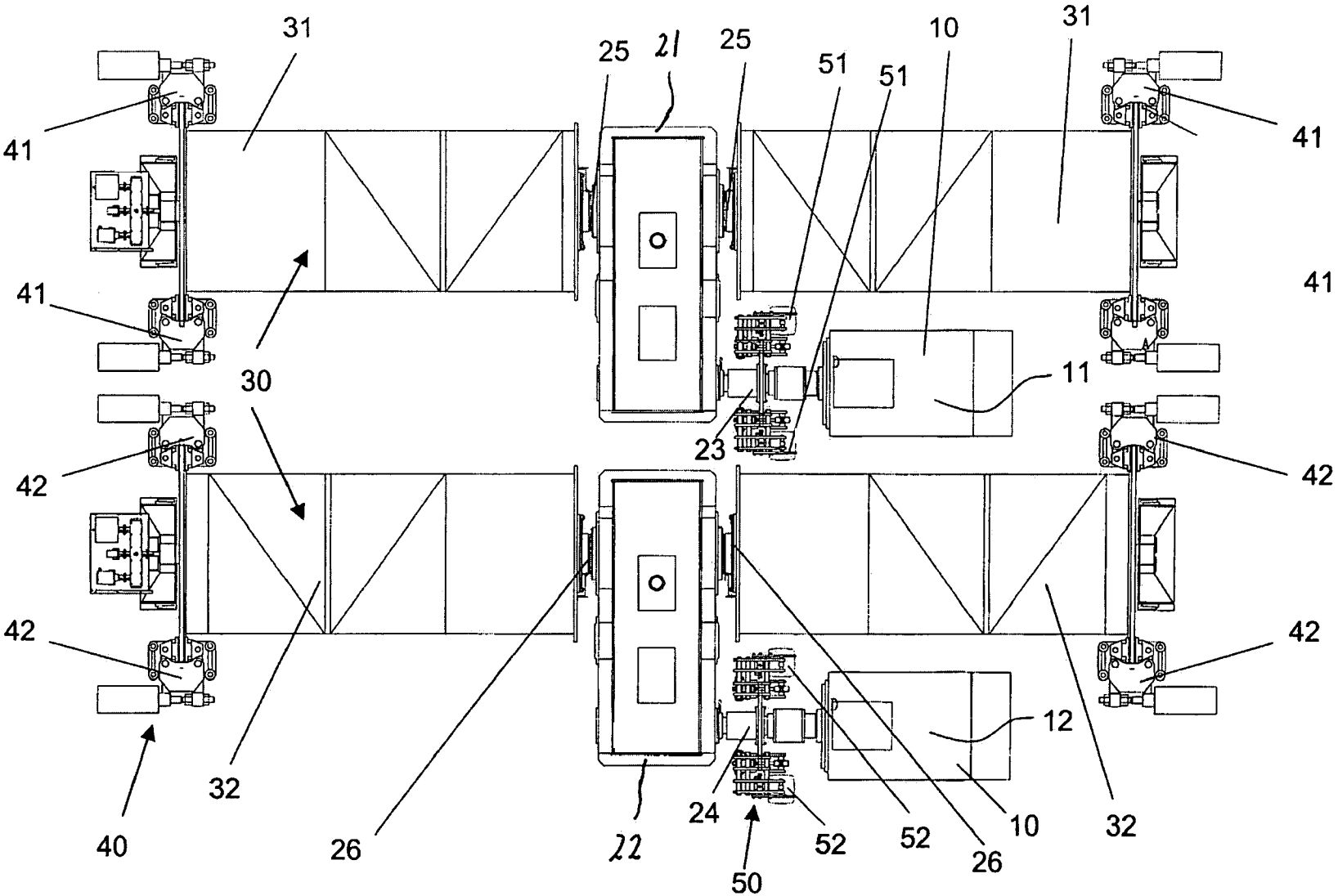
FIG. 3 is the schematic structure view of the third embodiment of the twin lifting machinery with two motors driving two four-project rope reels for two 40 feet container shore crane according to the invention.

Refer to FIG. 3.

According to the embodiment, the twin lifting machinery for two 40 feet container shore crane having two motors driving four two-project rope reels , said twin lifting machinery includes: motors 10, high speed brakes 50, two reductors 20, four two-project rope reels 30, and reel brakes 40 connecting to the four two-project rope reels 30 respectively;

Two motors are provided as motors 10;

Each one of the input ends of said two reductors 20 connect to one of the output ends of the motors 10 respectively.

Each one of the input ends of said two reductors 20 are provided on one of the high speed brakes 50 respectively;

The two-project rope reels 30 are provided on one of the output ends of the two reductors 20 respectively;

The reel brakes 40 are provided on each one of the two-project rope reel 30 respectively;

The (land side) reductor 21 has an output end 25, the output end 25 connects to two two-project rope reels 31, the two two-project rope reels 31 have four project ropes connecting to a hanger tool;

The (sea side) reductor 22 has an output end 26, the output end 26 connects to two two-project rope reels 32, the two two-project rope reels 32 have four project ropes connecting to another tool.

The reel brakes 41 are provided on two two-project rope reels 31 of the land side, and the reel brakes 42 are provided on two two-project rope reels 32 of the sea side.

The Fourth Embodiment

Figure 4:
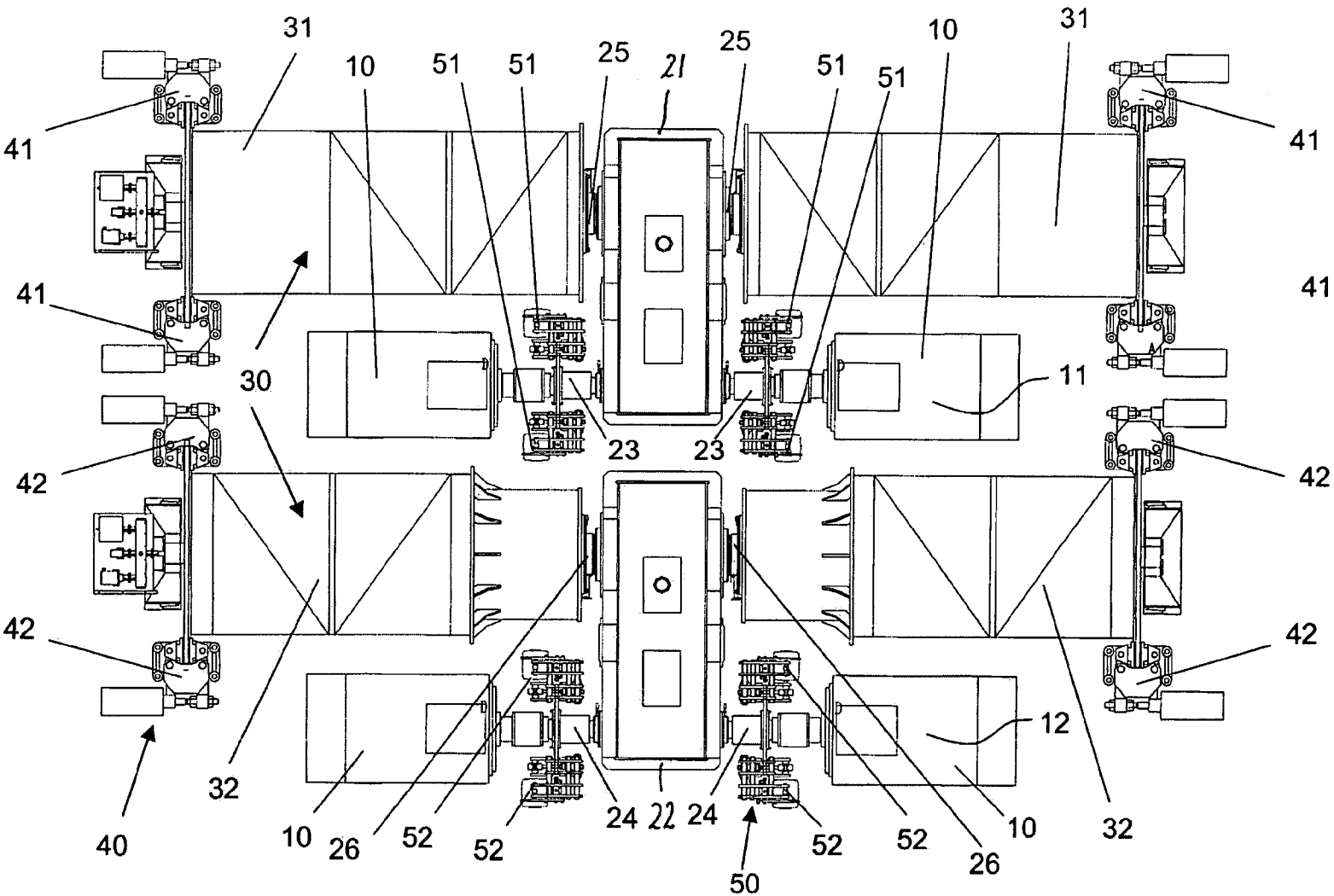
FIG. 4 is the schematic structure view of the fourth embodiment of the twin lifting machinery with two motors driving two four-project rope reels for two 40 feet container shore crane according to the invention.

Refer to FIG. 4.

According to the embodiment, the twin lifting machinery for two 40 feet container shore crane having four motors driving four two-project rope reels, said twin lifting machinery includes: motors 10, high speed brakes 50, two reductors 20, four two-project rope reels 30, and reel brakes 40 connecting to the four two-project rope reels 30 respectively;

Two motors are provided as motors 10;

Each one of the input ends of said two reductors 20 connect to one of the output ends of the motors 10 respectively.

Each one of the input ends of said two reductors 20 are provided on one of the high speed brakes 50 respectively;

The two-project rope reels 30 are provided on one of the output ends of said two reductors 20 respectively;

The reel brakes 40 are provided on said each two-project rope reel 30 respectively;

The (land side) reductor 21 has an output end 25, the output end 25 connects to two two-project rope reels 31, the two two-project rope reels 31 have four project ropes connecting to a hanger tool;

The (sea side) reductor 22 has an output end 26, the output end 26 connects to two two-project rope reels 32, the two two-project rope reels 32 have four project ropes connecting to another hanger tool.

The reel brakes 41 are provided on two two-project rope reels 31 of the land side, and the reel brakes 42 are provided on two two-project rope reels 32 of the sea side.

The twin lifting machinery for two 40 feet container shore crane of the invention uses two or four motors and two reductors, four two-project rope reels may be driven by two motors through two reductors, or four two-project rope reels may be driven by four motors through two reductors, or two four-project rope reels may be driven by two motors through two reductors, or two four-project rope reels may be driven by four motors through two reductors. Thus the synchronous operation or individual operation of two sets of lifting machineries under electrical control can be carried out, achieving the lifting and lowering operation of two hanger tools of sea side or land side. The twin lifting machinery can carry out both synchronous operation of two hanger tools and individual operation of a single hanger tool, increasing the loading and unloading efficiency of the container crane by more than 60%.

The invention claimed is:

1. A twin lifting machinery for a shore crane for lifting two 40 feet containers, comprising:

a plurality of motors;

a plurality of multiple rope reels, each reel having at least one reel brake;

a plurality of reduction gear boxes, each having at least one high speed input shaft that is connected to one of the motors and at least one low speed output shaft that is connected to one of the multiple rope reels;

a plurality of high speed brakes that each acts on the at least one high speed input shaft; and each of the at least one reel brake acts on the at least one low speed output shaft.

2. The twin lifting machinery of claim 1, wherein:

each of the plurality of reduction gear boxes has a first low speed output shaft and a second low speed output shaft;

the first low speed output shaft is connected to a first of the plurality of multiple rope reels having a plurality of ropes for connecting to a first spreader; and the second low speed output shaft is connected to a second of the plurality of multiple rope reels having a plurality of ropes for connecting to a second spreader.

3. The twin lifting machinery of claim 2, wherein:

the twin lifting machinery comprises two reel brakes being a first reel brake and a second reel brake;

the first reel brake is provided on a first of the plurality of the multiple rope reels; and the second reel brake is provided on a second of the plurality of the multiple rope reels.

4. The twin lifting machinery of claim 3, wherein:

the first multiple rope reel has four ropes for connecting to a first spreader; and the second multiple rope reel has four ropes for connecting to a second spreader.

5. The twin lifting machinery for claim 3, wherein:

the first multiple rope reel has two ropes for connecting to a first spreader; and the second multiple rope reel each has two ropes for connecting to a second spreader.

6. The twin lifting machinery of claim 1, wherein:

the twin lifting machinery comprises two motors being a first motor and a second motor;

an output end of the first motor is connected to a high speed input shaft of a first reduction gear box, and a first high speed brake is provided on the high speed input shaft of the first reduction gear box;

an output end of the second motor is connected to a high speed input shaft of a second reduction gear box, and a second high speed brake is provided on the high speed input shaft of the second reduction gear box.

7. The twin lifting machinery of claim 1, wherein:

the twin lifting machinery comprises four motors being a first motor, a second motor, a third motor, and a fourth motor;

output ends of the first motor and the second motor are connected to a high speed input shaft of a first reduction gear box, and a first high speed brake is provided on the high speed input shaft of the first reduction gear box;

output ends of the third motor and the fourth motor are connected to a high speed input shaft of a second reduction gear box, and a second high speed brake is provided on the high speed input shaft of the second reduction gear box.

* * * * *